US005554309A

United States Patent [19]

Bruce et al.

[11] Patent Number: 5,554,309

[45] Date of Patent: Sep. 10, 1996

[54] LUBRICANTS FOR CERAMICS AT ELEVATED TEMPERATURES

[75] Inventors: Robert W. Bruce, Monroeville; E. Erwin Klaus, State College, both of Pa.

[73] Assignee: Aluminum Company of America, Pittsburgh, Pa.

[21] Appl. No.: 398,966

[22] Filed: Aug. 28, 1989

[51] Int. Cl.[6] ..... C10M 129/10; C10M 137/04; C10M 137/02

[52] U.S. Cl. ..... 508/312; 508/421; 508/584

[58] Field of Search ..... 252/9, 49.8, 52 R

[56] References Cited

U.S. PATENT DOCUMENTS

| | | | |
|---|---|---|---|
| 3,629,114 | 12/1971 | Fairing | 252/49.8 |
| 3,671,434 | 6/1972 | Metro et al. | 252/49.8 |
| 3,978,908 | 9/1976 | Klaus et al. | 164/72 |
| 4,514,312 | 4/1985 | Root et al. | 252/32.5 |
| 4,734,213 | 3/1988 | Brewster et al. | 252/52 R |
| 4,786,424 | 11/1988 | Lindstrom et al. | 252/41 |

FOREIGN PATENT DOCUMENTS

| | | | |
|---|---|---|---|
| 704323 | 2/1965 | Canada | 252/49.8 |
| 731623 | 4/1966 | Canada | 252/49.8 |

OTHER PUBLICATIONS

Klaus et al, "Structure of Films Formed During the Deposition of Lubrication Molecules on Iron and Silicon Carbide", presented at the ASME/STLE Tribology Conference in Baltimore, Maryland, Oct. 16–19, 1988.

*Primary Examiner*—Gary L. Geist
*Attorney, Agent, or Firm*—David W. Pearce-Smith

[57] ABSTRACT

A method for reducing the coefficient of friction and wear at the interface of two ceramic surfaces at temperatures above approximately 600° F. The method comprising the steps of: a) providing a first and second ceramic surface; b) providing a lubricant selected from the group consisting of p-dodecylphenol, C26 and organophosphorus compounds; and c) applying the lubricant to the interface of the first and second ceramic surfaces at temperatures above approximately 600° F. to reduce the coefficient of friction at the interface.

18 Claims, No Drawings

LUBRICANTS FOR CERAMICS AT ELEVATED TEMPERATURES

TECHNICAL FIELD

The present invention relates to lubricants for reducing the coefficient of friction and wear at the interface of two ceramic surfaces at elevated temperatures. More particularly, the invention relates to the use of lubricants to reduce the coefficient of friction between two $Si_3N_4$ surfaces at temperatures above 600° F.

BACKGROUND ART

Materials requirements for aerospace applications are going through sweeping changes primarily due to defense related goals which include higher thrust-to-weight ratios, faster cruising speeds, increased altitudes and improved flight performance. When these goals are translated into material requirements, the general theme of incorporating lightweight material possessing increased strength at higher operating temperatures emerges. Ceramic materials such as silicon nitride ($Si_3N_4$), silicon carbide (SiC), silicon aluminum oxynitride (SiAlON), alumina ($Al_2O_3$) and titanium diboride are some of ceramic materials that have been found useful for high temperature applications.

However, the replacement of metal parts with ceramics is not as simple as has been initially suggested. One area which has been especially troublesome is the use of ceramic replacement parts in mechanical systems that require extreme pressure (EP) lubrication at elevated temperatures. Examples of mechanical systems can be found in turbojet engines where sliding contact occurs between parts sliding and rotating in bearings. These include subassemblies such as turbine shafts wherein the shafts rotate inside journal bearings or rolling contact bearings, valves wherein valve bodies slide against mating surfaces in their opening and closing motions, and afterburner gates which turn on cylindrical bearings sliding around shafts or on shafts rotating inside cylindrical bearings.

The problems that arise in the use of ceramic replacement parts in mechanical systems that require extreme pressure (EP) lubrication at elevated temperatures are due primarily to two conditions. The first is that the ceramics are being used under higher temperatures conditions than the metal that it is replacing. Lubricants that work well with metals at relatively low temperatures (below 1000° F.) do not necessarily function as lubricants above 1000° or 1200° F. Lubricants that have been used at these relatively lower temperatures have been found to polymerize, oxidize and/or thermally degrade into a solid at the higher temperature conditions that they are now being tested under. In addition, the solid material that the lubricants thermally degrade into, have in some instances been found to be a hard sticky substance that increases the coefficient of friction between the surfaces that it is to lubricate and could cause a seizure of the moving parts. Also, this solid material has been found to be extremely difficult to remove from surfaces that it has contacted. This translates into increased downtime in the event that the maximum temperature, for which the lubricant has been designed, has been exceeded.

The second problem that arises in the use of ceramic replacement parts in mechanical systems that require extreme pressure (EP) lubrication at elevated temperatures, is that the lubricants that lower the coefficient of friction between metals at elevated surfaces do not necessarily function as lubricants for ceramic surfaces. The use of the wrong lubricant will increase the coefficient of friction between the ceramic surfaces and may cause a greater tendency for the surfaces to seize than when no lubricant is used.

U.S. Pat. No. 3,978,908, issued to Klaus et al, discloses a method of die casting metal. In this method the mold or die surface is contacted with a vapor lubricant or parting agent such as an alkyl phosphate or an aryl phosphate, e.g., tricresyl phosphate and tributyl phosphate. The vapor lubricant may be applied at temperatures as high as 1200° F.

A great deal of work has been done on the vapor lubricants of U.S. Pat. No. 3,978,908. Klaus et al in an article entitled "Structure of Films Formed During the Deposition of Lubrication Molecules on Iron and Silicon Carbide", presented as a Society of Tribologists and Lubrication Engineers paper at the ASME/STLE Tribology Conference, October 1988, have found that impinging tricresyl phosphate (TCP) molecules thermally decompose and interact with the iron surface to form two types of crystalline structures. One structure apparently consists of large, oriented cementite ($Fe_3C$) crystals. Klaus theorized that this layer probably grows by diffusion of carbon fragment from the TCP into the original foil material and subsequent reaction. The results suggest that iron in some form acts as a catalyst for the initial adsorption and decomposition of the TCP, and there is some iron transport process that can operate through several thousand monolayers of coating. With regard to the SiC substrate, there was no evidence to suggest that the ceramic played a role other than to provide thermal energy.

Alkyl and aryl phosphates require the presence of a metal oxides, such as iron in the form such as $Fe_2O_3$, which react with the phosphate at high temperature to form the lubricant. Other metal oxides such as oxides of other transitional metals such as nickel, chrome or manganese, for example, have also been found to react with the phosphate at high temperatures to form lubricants. These other metal oxides are also obtained from the metal surfaces which were being lubricated.

When lubricating ceramic surfaces of high temperature ceramics, such as silicon nitride ($Si_3N_4$), silicon carbide (SiC), silicon aluminum oxynitride (SiAlON), alumina ($Al_2O_3$) and titanium diboride, there are no metal oxides present to react with the phosphate. If $Fe_2O_3$ is added to the parting agents so that the phosphate containing parting agent can act a lubricant at high temperatures to lubricate ceramic surfaces, the $Fe_2O_3$ will also react with silica in the ceramic to produce an FeSi phase which will reduce the strength of the ceramic and cause its surface to degrade. The formation of an FeSi phase and its detrimental effects on ceramics is well known. Those skilled in the art would not normally think of using iron in a parting agent that is to be used for high temperature ceramics.

It would be advantageous, therefore, to provide a lubricant that can be used for lubricating ceramic surfaces, such as silicon nitride ($Si_3N_4$), silicon carbide (SiC), silicon aluminum oxynitride (SiAlON), alumina ($Al_2O_3$), aluminum phosphate (AlP), zirconia ($ZrO_2$) and titanium diboride at temperatures above 1000° F.

The principal object of the present invention is to provide a system for lubricating ceramic surfaces at elevated temperatures which does not require the formation of transition metal silicides to form a lubricant.

Another object of the present invention is to provide a lubricant for use with $Si_3N_4$ that can be used at temperatures above 1000° F.

Additional objects and advantages of the present invention will be more fully understood and appreciated with reference to the following description.

DISCLOSURE OF THE INVENTION

In accordance with the present invention, a lubricant for reducing the coefficient of friction at the interface of ceramic surfaces at temperatures greater than about 1000° F. is disclosed. The lubricant is selected from the group of p-dodecylphenol, oxidized mineral oil having a chain of 26 carbon atoms, and organophosphorus compounds. Some preferred organophosphorus compounds include alkyl phosphates, aryl phosphates, alkaryl phosphates, aralkyl phosphates, mixed alkyl aryl phosphates, alkyl phosphites, aryl phosphites, alkaryl phosphites, aralkyl phosphites, and mixed alkyl aryl phosphites. Additives that are especially useful in practicing the present invention are the lower molecular weight $C_1$–$C_7$ trialkyl phosphates, such as tributyl phosphate, and the $C_6$–$C_{18}$ triaryl phosphates, such as tricresyl phosphate, and derivatives thereof.

In a first preferred embodiment of the present invention, the ceramic material is $Si_3N_4$ and the lubricant is tributyl phosphate.

In a second preferred embodiment of the present invention, the ceramic material is SiAlON and the lubricant is tributyl phosphate.

Other features of the present invention will be further described or rendered obvious in the following related description of the preferred embodiments.

MODES FOR CARRYING OUT THE INVENTION

It has been found that the coefficient of friction of various ceramic substrates at elevated temperatures can be reduced by the application of the lubricants disclosed herein.

The basic ceramic materials for use in the system of the present invention can be fabricated from a wide variety of materials, among them, $Si_3N_4$, SiC, SiAlON, $Al_2O_3$ and $TiB_2$ and other high temperature ceramic materials. $Si_3N_4$ has been found to be especially useful in the high temperature applications to which the present invention is directed.

Various, even conventional, mold lubricants are usefully employed in the practices of this invention. The lubricant is applied to the ceramic surface in vapor or gaseous form and in the substantial absence of added liquiform or liquid lubricant. Suitable lubricants in the practices of this invention include the organic compounds, such as esters of mono- and polybasic acids, such as the phosphorus acids, e.g., phosphoric acid, including mono- and polycarboxylic acids, the polyol esters of monobasic acids, the polyesters, the silicate esters, the silicones, polyolefins and the borate esters, and combinations thereof. Particularly useful in the practices of this invention are the organophosphorus compounds, such as the alkyl phosphates, the aryl phosphates, the alkaryl phosphates, the aralkyl phosphates, the mixed alkyl aryl phosphates, the alkyl phosphites, the aryl phosphites, the alkaryl phosphites, the aralkyl phosphites, the mixed alkyl aryl phosphites and also the above-mentioned corresponding phosphonates and the other phosphorus-containing organic compounds. Especially useful are the lower molecular weight $C_1$–$C_7$ trialkyl phosphates, such as tributyl phosphate, and the $C_6$–$C_{18}$ triaryl phosphates, such as tricresyl phosphate, and derivatives thereof.

In the practice of this invention, it is preferred to employ as the lubricant an organic compound, such as an ester, or one of the aforementioned organophosphorus compounds which thermally decompose at a temperature above about 400° F., preferably above 600° F., such as a temperature in the range of about 700°–1200° F.

It is also preferred that the vapor form or vaporized lubricant when applied to the ceramic surface be at a fairly high temperature, that is, the vapor be applied at the highest practical temperature in order to maximize the vapor pressure of the applied lubricant without undue deterioration or decomposition of the lubricant during vaporization and prior to contact with the ceramic surface. Since many useful lubricants are organic compounds which decompose at or about their atmospheric boiling point, the vaporized organic lubricants are usually applied at temperatures below their boiling point, e.g., tributyl phosphate (b.p. about 560° F.) at a temperature of about 400° F. and tricresyl phosphate (b.p. about 790° F.) at a temperature of about 650° F. It is particularly preferred in the practice of this invention that the vapor form or vaporized lubricant be applied to the surface of the ceramic material wherein the initial temperature of the ceramic surface on contact with the vaporized lubricant is above 400° F., preferably above 600° F., such as in the range 700°–1200° F., at a temperature and under conditions, such as time of application or exposure, sufficient to effect thermal decomposition, oxidation or polymerization of the applied vapor to form a lubricant film on the ceramic surface.

In one special embodiment of the practices of this invention, vaporized lubricant is applied to the ceramic surface and maintained in contact therewith under conditions to effect thermal decomposition, oxidation or polymerization of the vaporized lubricant on the solid surface. Depending upon the chemical make-up of the lubricant, the vaporized lubricant will thermally decompose on the surface of the solid at varying decomposition, oxidation or polymerization temperatures and periods of residence or contact therewith. As mentioned hereinabove, it is preferred to employ a lubricant which thermally decomposes at a temperature above 400° F., preferably above 600° F., such as a temperature in the range from about 650°–700° F. to about 900°–1200° F. The ceramic surface upon initial contact of the vaporized lubricant is preferably at a temperature of at least 400° F., preferably above 600° F., such as a temperature in the range of about 900°–1500° F.

As indicated hereinabove, it is preferred to maintain the vaporized lubricant in contact with the hot ceramic surface for a substantial period of time, such as a period of time of about 3 seconds to about 60 seconds, more or less. The time the vaporized lubricant is maintained in contact with the ceramic surface in order to provide an effective lubricating or parting surface or coating thereon depends on various factors including, among others, the temperature of the ceramic surface, the temperature of the vaporized lubricant, the partial pressure of the vaporized lubricant and the chemical make-up of the lubricant itself and the ceramic surface.

In the practice of this invention, as indicated hereinabove, it is preferred to apply the vaporized lubricant to the ceramic surface under conditions such that vaporized lubricant is carried to or applied to the ceramic surface by way of and in the presence of a carrier gas, such as air, nitrogen, carbon dioxide, helium, argon and the like. Depending upon the combination of the aforesaid conditions, various thicknesses of the applied lubricant can be deposited on the surface. Partial pressure of the applied vaporized lubricant is preferably above 25–50 mm Hg, such as in the range from about 60–65 to about 250–500 mm Hg.

The lubricant applied to and deposited on the ceramic surface may have a thickness in the range from a few, about 5, molecular layers of the applied lubricant, such as when the vaporized lubricant is applied to contact the mold surface at a low temperature of about 400° F. and maintained in contact therewith for a short period of time of a few seconds, e.g. 3, up to a thickness of about hundreds and even a few thousand, such as 3000, molecular layers as when the applied vaporized lubricant at a high partial pressure is maintained in contact with the ceramic surface for an extended period of time of about 15 seconds, even up to 60 seconds and more, and the temperature of the ceramic surface is greater than 700° F., such as about 1200° F. Under such conditions, having in mind that a molecular monolayer of tricresyl phosphate has a thickness estimated at about $1\times10^{-7}$ cm and a molecular monolayer or monomolecular layer of tributyl phosphate has an estimated thickness of about $9.52\times10^{-8}$ cm, a substantial thickness of lubricant, measured or calculated as molecular layers of the applied lubricant, can be built up upon a ceramic surface. When organophosphorus compounds are employed as lubricants and when the surface temperature of the ceramic is above the decomposition temperature of the applied lubricant, there would be produced a phosphorus-rich or phosphorus-containing coating (the resulting thermal decomposition products) on the ceramic surface which would serve as the actual lubricant or parting agent for reduced friction between and/or the release of the ceramic surfaces from each other. Reducing the friction in brittle ceramics is likely to reduce surface wear and extend its work life.

In accordance with this invention, the ceramic surfaces are contacted with a lubricant or parting agent in a vapor form. More specifically, in accordance with the practice of this invention, the surface of the ceramic material is treated with a lubricant or parting agent in vapor or gaseous form, i.e., in a homogeneous gas phase, prior to bringing the resulting treated ceramic surfaces into contact. The vaporous lubricant or parting agent is applied to the ceramic surface under conditions such that the applied lubricant or parting agent undergoes thermal decomposition thereon.

By introducing the lubricant or parting agent in vapor or gaseous form into contact with the ceramic surfaces, shock-cooling of the surface is avoided. As an ancillary benefit, the cooling rate of the die or mold can be controlled to minimize thermal fatigue. Since the ceramic surface is treated by contact with the lubricant or parting agent in gaseous or vapor form, desirably in the presence of a carrier gas, such as air, carbon dioxide, nitrogen, helium or argon, or other suitable inert gas, and desirably in the absence of liquid lubricant or parting agent, fire hazards and problems of air pollution, heretofore experienced when a liquid lubricant was applied to a hot ceramic surface, are reduced or avoided.

Desirably, the vapor form or gaseous form lubricant, in the substantial absence of a liquid lubricant, is applied to the usually hot ceramic surface. By applying the lubricant in this manner, the ventilation requirements for a safe work space are minimized.

The following examples are offered to illustrate the present invention.

EXAMPLE 1

Two surfaces of SiALON, $Si_3N_4$, SiC, $Al_2O_3$, and $TiB_2$ heated to approximately 700° C. Once it was determined that the materials were at the desired temperature, they were removed from the furnace and immediately rotated against each other to determine the coefficient of friction for the interface of each material against itself. The tests were conducted by rotating one 0.8 inch diameter surface against another surface of the same material at a speed of 45 rotations per minute and under a 500 pound load. Each test lasted 1.3 seconds. All the tests were conducted without lubricating the surfaces and the results were recorded and entered in Table 1. These tests were performed to obtain values and to establish a baseline for the purpose of comparing the effectiveness of various lubricants in reducing the coefficient of friction at a given torque.

EXAMPLE 2

The tests performed in Example 1 were repeated except that a vapor of 0.5 ml of p-dodecylphenol ($C_{12}H_{25}C_6H4OH$) was sprayed onto the hot interface of the SiALON, $Si_3N_4$, SiC, $Al_2O_3$, and $TiB_2$ surfaces in equivalent quantities over the deposition time. Nitrogen was used as a carrier gas for the p-dodecylphenol vapor. The deposition step was preformed while the materials were still in the furnace. The coefficient of friction was determined and the results of Example 2 were recorded on Table 1.

EXAMPLE 3

The tests performed in Example 1 were repeated except that a vapor of 0.5 ml of an oxidized mineral oil having an average chain of carbon atoms twenty-six atoms in length was sprayed onto the interface of the SiALON, $Si_3N_4$, SiC, $Al_2O_3$, and $TiB_2$ surfaces in equivalent quantities. Nitrogen was used as a carrier gas for the vapor of oxidized mineral oil. The deposition step was preformed while the materials were still in the furnace. The coefficient of friction was determined and the results of Example 3 were recorded on Table 1.

EXAMPLE 4

The tests performed in Example 1 were repeated except that a vapor of 0.5 ml of tricresyl phosphate was sprayed onto the interface of the SiALON, $Si_3N_4$, SiC, $Al_2O_3$, and $TiB_2$ surfaces in equivalent quantities. Nitrogen was used as a carrier gas for the vapor of tricresyl phosphate. The deposition step was preformed while the materials were still in the furnace. The coefficient of friction was determined and the results of Example 4 were recorded on Table 1.

EXAMPLE 5

The tests performed in Example 1 were repeated except that a vapor of 0.5 ml of tributyl phosphate was sprayed onto the interface of the SiALON, $Si_3N_4$, SiC, $Al_2O_3$, and $TiB_2$ surfaces in equivalent quantities. Nitrogen was used as a carrier gas for the vapor of tributyl phosphate. The deposition step was preformed while the materials were still in the furnace. The coefficient of friction was determined and the results of Example 5 were recorded on Table 1. As can be seen on Table 1, tributyl phosphate lubricant caused the greatest reduction in the coefficient of friction of the various lubricants tested for SiAlON and SiC. In addition, tributyl phosphate and p-dodecylphenol ($C_{12}H_{25}C_6H_4OH$) caused the greatest reduction in the coefficient of friction of for $Si_3N_4$ and tributyl phosphate and tricresyl phosphate caused the greatest reduction in the coefficient of friction of for $Al_2O_3$.

TABLE 1

Torque (inch lbs.) as Function of Lubricant Vapor Composition For Various Ceramic Materials

| | Ceramic Composition | | | | |
|---|---|---|---|---|---|
| Example | SiAlON | $Si_3N_4$ | SiC | $Al_2O_3$ | $TiB_2$ |
| 1 | 36.1 | 41.8 | 38.4 | 54.9 | 17.4 |
| 2 | 13.7 | 8.1 | 14.8 | 26.7 | — |
| 3 | 22.8 | 14.4 | 18.7 | 17.1 | 2.9 |
| 4 | 13.6 | 14.9 | 22.5 | 14.8 | — |
| 5 | 11.7 | 8.1 | 13.9 | 14.8 | — |

INDUSTRIAL APPLICABILITY

It will be apparent from what has been described herein that the invention has wide industrial applicability particularly in the form of, for example, aircraft and missile parts where the special high temperature environments of the turbine engines make the potential of high temperature lubricants and their use for lubricating ceramics surfaces quite attractive.

The practice of this invention is particularly applicable for ceramic bearings, gun barrels, and adiabatic engines.

It is also contemplated that different amounts of lubricating material may be used in practicing the present invention. Thus for example, other than 1 wt % may be used. One skilled in the art will appreciate that the higher the weight percent of lubricating material that is actually used the tester the film builds up on the surface. Although amounts as high as 10% may be used, the upper limit of the actual amount is not critical to practicing the invention. At the lower limit of seed material used in practicing the present invention, the rate of reaction may still be sufficient when the percentage of material is below 0.001%.

Although the invention has been described in terms of a vapor lubricant using nitrogen as a carrier gas, it is not intended to be so limited. Other known carrier gases can be used. Thus for example, oxygen or air may be used in practicing the present invention.

While the invention has been described in terms of preferred embodiments, it is intended that all matter contained in the above description shall be interpreted as illustrative. The present invention is indicated by the broad general meaning of the terms in which the appended claims are expressed.

What is claimed is:

1. A method for lubricating the interface of two ceramic surfaces in frictional contact in mechanical systems that operate at temperatures above approximately 600° F., said method comprising the steps of:

providing a first and second ceramic surface;

providing a lubricant selected from the group consisting of p-dodecylphenol, oxidized mineral oil and organophosphorus compounds having an average chain of carbon atoms less than or equal to twenty-one;

applying said lubricant to the interface of said first and second ceramic surfaces at temperatures above approximately 600° F.

2. The method of claim 1 in which the step of providing a first and second ceramic surface:

providing a first and second ceramic surface made of a material selected from the group of silicon nitride, silicon carbide, silicon aluminum oxynitride, alumina and titanium diboride.

3. The method of claim 1 in which the step of providing a lubricant includes:

providing a lubricant selected from the group of organophosphorus compounds which includes alkyl phosphates, aryl phosphates, alkaryl phosphates, aralkyl phosphates, mixed alkyl aryl phosphates, alkyl phosphites, aryl phosphites, alkaryl phosphites, aralkyl phosphites, and mixed alkyl aryl phosphites.

4. The method of claim 1 in which the step of providing a lubricant includes:

providing a lubricant that is a lower molecular weight $C_1$–$C_7$ trialkyl phosphate.

5. The method of claim 1 in which the step of providing a lubricant includes:

providing a lubricant that is tributyl phosphate.

6. The method of claim 1 in which the step of providing a lubricant includes:

providing a lubricant that is a $C_6$–$C_{18}$ triaryl phosphate.

7. The method of claim 1 in which the step of providing a lubricant includes:

providing a lubricant that is tricresyl phosphate.

8. The method of claim 1 in which the step of providing a lubricant includes:

providing a lubricant that is an oxidized mineral oil having an average chain of carbon atoms twenty-six atoms in length.

9. The method of claim 1 in which the step of applying said lubricant to the interface of said first and second ceramic surfaces at temperatures above 600° F., includes:

applying said lubricant to said interface by vapor deposition.

10. The method of claim 1 in which the step of applying said lubricant to the interface of said first and second ceramic surfaces at temperatures above 600° F., includes:

applying said lubricant to said interface at temperatures greater than about 1200° F.

11. The method of claim 1 in which the step of providing a first and second ceramic surface, includes:

providing a ball bearing having a ceramic surface.

12. The method of claim 1 in which the step of applying said lubricant to the interface of said first and second ceramic surfaces at temperatures above 600° F., includes:

applying said lubricant to said interface in the substantial absence of a transition metal oxide to aid in the lubrication of said ceramic surfaces.

13. The method of claim 1 in which said lubricant undergoes a chemical reaction at said interface.

14. The method of claim 13 in which said chemical reaction at said interface involves a reaction between said surfaces and said lubricant.

15. The method of claim 13 in which said chemical reaction at said interface involves a reaction between said surfaces, said lubricant and a gas carrier for said lubricant.

16. A method for lubricating the interface of two ceramic surfaces in frictional contact in mechanical systems that operate at temperatures above approximately 1000° F., said method comprising the steps of:

providing a first and second ceramic surface;

spraying a lubricant selected from the group consisting of p-dodecylphenol, oxidized mineral oil and organophosphorus compounds having an average chain of carbon atoms less than or equal to twenty-one at the interface of said first and second ceramic surfaces at temperatures above approximately 600° F.;

applying said lubricant to the interface of said first and second ceramic surfaces at temperatures above approximately 600° F.

17. The method of claim 16 in which the step of spraying a lubricant includes:

spraying said lubricant in a carrier gas selected from the group of nitrogen, oxygen and air.

18. The method of claim 16 in which the step of providing a first and second ceramic surface includes:

providing a first and second ceramic surface made of a material selected from the group of silicon nitride, silicon carbide, silicon aluminum oxynitride, alumina and titanium diboride.

* * * * *